United States Patent [19]

Pitkäjärvi

[11] Patent Number: 4,683,027

[45] Date of Patent: Jul. 28, 1987

[54] METHOD AND APPARATUS IN A PAPER MACHINE FOR REGULATING PRESSURE IN THE SPACE BETWEEN A HEADBOX LIP BEAM AND BREAST ROLL

[75] Inventor: Kari Pitkäjärvi, Jyväskylä, Finland

[73] Assignee: Valmet Oy, Finland

[21] Appl. No.: 790,853

[22] Filed: Oct. 24, 1985

[30] Foreign Application Priority Data

Oct. 25, 1984 [FI] Finland ..... 844203

[51] Int. Cl.[4] ..... D21F 1/02

[52] U.S. Cl. ..... 162/199; 162/212; 162/252; 162/275; 162/336

[58] Field of Search ..... 162/212, 214, 252, 259, 162/272, 275, 315, 317, 318, 336, 380, 199

[56] References Cited

U.S. PATENT DOCUMENTS

| | | | |
|---|---|---|---|
| Re. 25,333 | 2/1963 | Baxter, Jr. | 162/317 |
| 2,255,951 | 9/1941 | Tomtlund | 162/336 |
| 2,756,651 | 7/1956 | Lee | 162/317 |
| 3,005,746 | 10/1961 | Baxter, Jr. | 162/212 |

*Primary Examiner*—S. Leon Bashore
*Assistant Examiner*—K. M. Hastings
*Attorney, Agent, or Firm*—Steinberg & Raskin

[57] ABSTRACT

Method and apparatus for regulating pressure in a wedge-shaped space between the wall of the headbox lip beam or the like and the breast roll. An arrangement is provided by which air jets are directed in a direction opposite to the direction in which the forming wire moves on the breast roll to eject air out of the wedge-shaped space to maintain the pressure induced therein at a desired level. The apparatus includes a blow box coupled to a source of pressurized air and the box having a wall in opposed relationship to the forming wire in which nozzle openings or slots are formed through which the air jets are directed. The blow box has a wider side which substantially closes the wedge-shaped space. Water jets are directed into the wedge-shaped space by water supply devices provided on the blow box for cleaning purposes.

17 Claims, 3 Drawing Figures

METHOD AND APPARATUS IN A PAPER MACHINE FOR REGULATING PRESSURE IN THE SPACE BETWEEN A HEADBOX LIP BEAM AND BREAST ROLL

BACKGROUND OF THE INVENTION

The present invention relates generally to paper machines and, more particularly, to methods and apparatus for preventing the formation of an unduly high positive pressure and for maintaining the pressure at a desired level in a wedge-shaped space formed between the wall of the headbox lip beam or the like and the breast roll.

In paper machines it is conventional to support the lower lip wall of the headbox by a lower lip beam which generally comprises a box beam having a substantially triangular cross section, the "hypotenuse" of the triangular cross section being constituted by a curved wall which defines a narrowing wedge-shaped space with the breast roll of the paper machine. The forming wire, e.g., a fourdrinier wire, is passed over and moves on the breast roll.

In twin wire formers which include two breast rolls, two such wedge-shaped spaces are formed between the respective curved walls of both of the lip beams and the respective breast rolls.

The invention has applicability both to single wire as well as twin wire formers and to formers in which the direction of feed of the pulp suspension is substantially vertical as well as to formers wherein the pulp suspension is fed in a substantially horizontal direction.

The rotating breast roll or rolls and the forming wire or wires passing over the same induce a positive pressure in the wedge-shaped space or spaces during operation of the paper machine. Such positive pressure results in an air flow between the pulp suspension jet and the wire as well as through the layer of the pulp suspension. Such an air flow often results in the creation of "pinholes" in the web being formed which adversely affects the quality of the paper produced by the paper machine.

In an attempt to overcome this problem, it has been suggested to provide large openings at both lateral sides of the wedge-shaped space through which a large quantity of air and water spray carried along by the wire can be suctioned. However, it has not been possible to alleviate the problem in this manner in actual practice.

In another attempt to overcome the problem, it has been suggested to feed water into the wedge-shaped space to thereby prevent air from entering into the space. This attempted solution has not proven satisfactory in practice since it has not been possible to completely eliminate access by air into the wedge-shaped space. Even if it were possible to prevent access of air into the wedge-shaped space by feeding water into it, such a large quantity of water would be necessary that the water discharged into the wedge-shaped space between the wire and the pulp suspension would cause the suspension to become diluted. Moreover, the injection of water into the space causes a detrimental transverse flow of the pulp suspension and resulting uneven web formation.

Indeed, it is known to those skilled in the art that the precise conditions that exist within the zone at which the pulp suspension jet is discharged onto the fourdrinier wire or between two wires are rather critical with respect to the qualitative properties of the paper being produced.

SUMMARY OF THE INVENTION

Accordingly, it is an object of the present invention to provide a control for and an improvement of the conditions in the zone at which the pulp suspension jet is discharged onto the fourdrinier wire or wires.

Another object of the present invention is to provide new and improved methods and apparatus for maintaining the pressure induced in the wedge-shaped space between the headbox lip beam and the breast roll at a desired level.

Briefly, in accordance with the present invention, these and other objects are attained by a method wherein air jets are directed from the wedge-shaped space in a direction opposite to the direction in which the forming wire passes over the breast roll so that by means of the air jets, air is ejected from the wedge-shaped space to maintain the pressure therein at a desired level.

In accordance with the invention, apparatus are provided comprising blow box means which are situated in the wedge-shaped space for directing air jets from the wedge-shape space in a direction opposite to the direction in which the forming wire moves on the breast roll. The blow box means may comprise a box having a wall situated in substantially opposed relationship to the breast roll. Nozzle openings or slots are provided in the blow box wall through which air jets are directed from the box in a direction opposite to the running direction of the forming wire facing the box to eject air from the wedge-shaped space. The blow box substantially closes the wedge-shaped space at the wider side thereof.

By means of the method and apparatus of the invention, the high positive pressure normally induced in the space between the lower lip of the headbox and the breast roll can be reduced to a suitable level, generally substantially equal to atmospheric pressure, so that detrimental air flows will not occur to any substantial extent.

Water spray devices may be advantageously incorporated in the apparatus by which cleaning water is sprayed into the narrow tip of the wedge-shaped space. Such provision eliminates the need for a separate spray pipe.

The extent to which the arrangement of the invention can control the pressure level in the wedge-shaped space can be controlled by adjusting the pressure of the air supplied to the blow box and/or by regulating the position of the blow box in the longitudinal direction within the wedge-shaped space.

In accordance with another feature of the present invention, means may be provided on the blow box for preventing the forming wire from becoming packed into the wedge-shaped space in the case where the forming wire is broken during operation.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
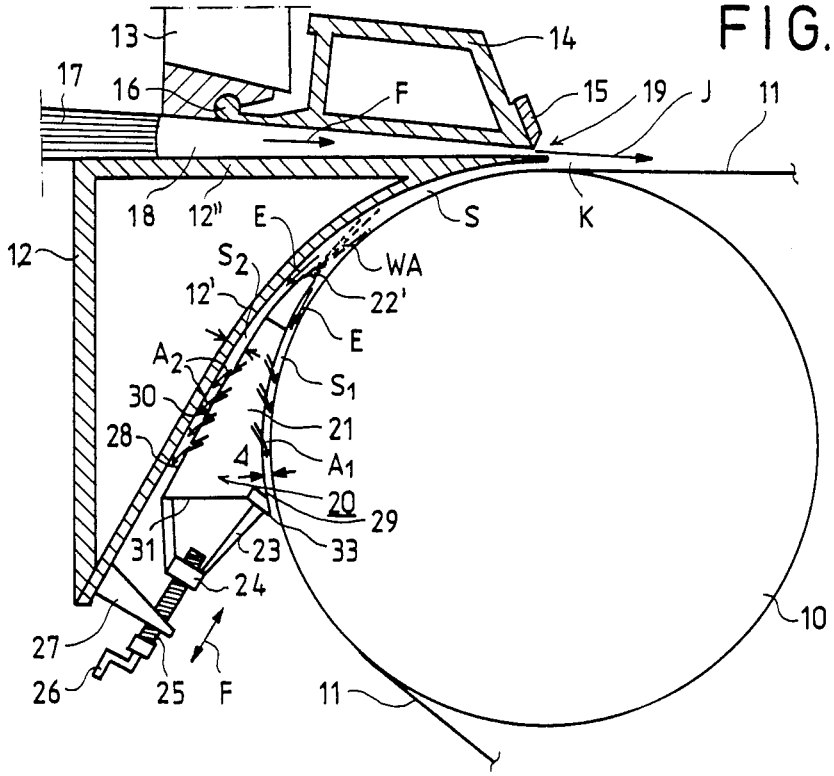
FIG. 1 is a side elevation view in section of one embodiment of apparatus in accordance with the invention wherein gap spaces are formed at both sides of a blow box.
Figure 2:
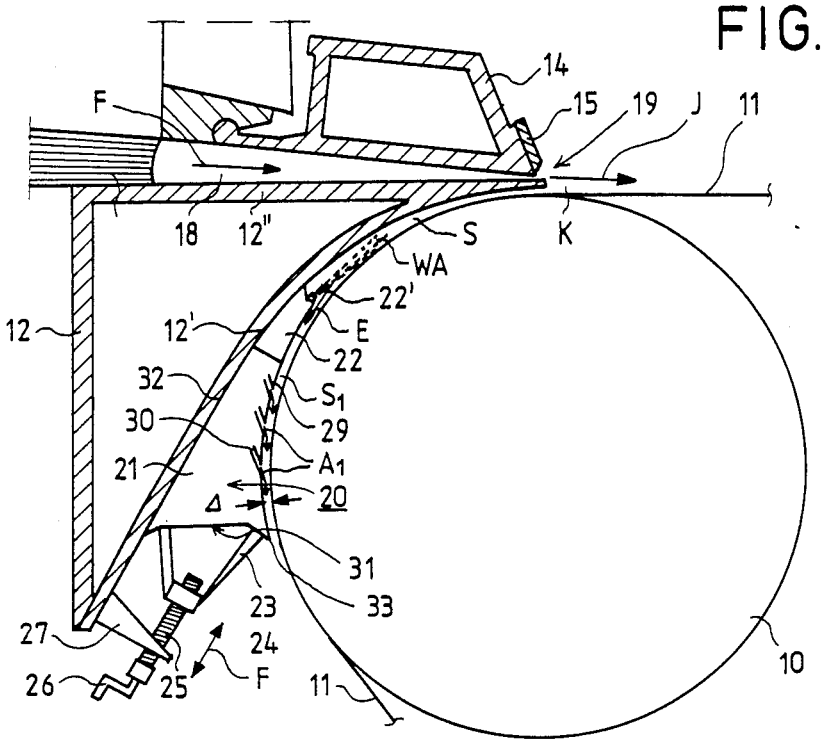
FIG. 2 is a view similar to FIG. 1 of another embodiment of apparatus in accordance with the invention wherein a gap space is formed only on the breast roll side of the blow box.

Referring now to the drawings wherein like reference characters designate identical or corresponding parts throughout the several views, the embodiments illustrated in FIGS. 1 and 2 are applied in a single-wire fourdrinier former. As noted above, however, the invention may also be applied in twin-wire formers, both vertical and horizontal, in both of the wedge-shaped spaces presented therein.

In both of the embodiments of FIGS. 1 and 2, a forming wire 11 runs over a breast roll 10. A lower-lip beam 12 has a curved wall 12' which, together with the breast roll 10 and the forming wire 11, defines a wedge-shaped space, designated S, which narrows in the direction of run of wire 11. The upper lip construction is also schematically shown in FIGS. 1 and 2 and includes an upper lip beam 14 and a profile bar 15 mounted on the front wall of beam 14 to determine the size of the discharge opening 19 through which the pulp suspension jet is discharged. The upper lip beam 14 is attached to another component 13 of the upper lip construction by means of an articulated joint 16 as is conventional. A turbulence generator 17 extending in the direction of flow of the pulp suspension is provided in the headbox in a conventional manner. After being discharged from the turbulence generator, 17, the pulp suspension flow F enters into the slice cone 18 passing therethrough to be discharged in the form of a suspension jet J through the slice 19 onto the fourdrinier wire 11. The slice cone 18 is defined at its lower side by the planar wall 12'' of lower lip beam 12.

The construction described above is conventional. Operation of the paper machine has in the past resulted in a high positive pressure being induced in the wedge-shaped space S causing disruption of the pulp suspension and pin-holes in the formed web. It is an object of the invention to maintain the pressure induced in the wedge-shape space S at a desired level to improve the quality of paper manufactured.

In accordance with the invention, apparatus are provided for directing air jets from the wedge-shaped space S in a direction opposite to the direction in which the forming wire 11 runs over the breast roll so that by means of the air jets, air is ejected from the wedge-shaped space S to maintain the pressure therein at a desired level.

The air jets are directed by means of air blow means 20 which in the illustrated embodiments takes the form of an air blow box 21 situated in the wedge-shaped space S. The blow box 21 is de fined by side walls 28 and 29 and bottom wall 31. A plurality of successive nozzle slots 30 direct air jets $A_1$ (FIGS. 1 and 2) and $A_2$ (FIG. 1) downwardly, i e., in a direction opposite to the direction of run of the wire 11 on breast roll 10. By means of air jets $A_1$ and $A_2$, air E is ejected out of the wedge-shaped space S defined by the air blow means 20 to such an extent that a pressure substantially equal to the ambient atmospheric pressure will be maintained in the space S so that no detrimental air flows are discharged from the space S and, in particular, so that no air flow will exist in the space K between the wire 11 and the pulp suspension jet J.

The air blow device 20 in accordance with the invention extends in the transverse direction of the paper machine over substantially the entire width of the wire 11. The blow box 21 comprising the air blow means 20 in the illustrated embodiments is provided with closed ends and is connected to a conventional compressed air source.

A compartment 22 is provided at the tip of blow box 21 from which water jets WA are directed by means of nozzles 22' into the narrow tip end of the space S to clean this space. The water jets WA consist of a relatively small amount of water so that the water will not disturb the supply of the pulp suspension jet J onto the wire 11 or otherwise affect the critical initial stage of web formation.

Referring in particular to the embodiment of FIG. 1, the blow box 21 includes a pair of side walls 28 and 29 which define a pair of gap spaces $S_1$ and $S_2$ with the lower lip beam wall 12' and the breast roll 10, respectively. The air Jets $A_1$ and $A_2$ are directed into gap spaces $S_1$ and $S_2$ respectively. The width dimension $\Delta$ of the gap spaces $S_1$ and $S_2$ is generally within the range of between about 5 and 30 mm, preferably about 10 to 15 mm.

Referring to the embodiment of FIG. 2, the blow box 21 is situated against the lower lip beam wall 12' so that the gap space $S_2$ provided in the embodiment of FIG. 1 is eliminated. In this case, air jets $A_1$ are directed out of the blow box 21 into only the gap space $S_1$ defined between the blow box wall 29 and the wire carrying breast roll 10.

In accordance with another feature of the invention, the blow box 21 is mounted to support structures 23 by means of which the blow box 21 is situated within the wedge-shaped space S in a manner so as to be positionally adjustable therein in the longitudinal direction. In accordance with the illustrated embodiments, an internally threaded nut member 24 is fixed to the support structures 23 and an externally threaded screw 25 is associated with the nut member 24. The screw 25 threadedly engages an internally threaded bracket 27 which is fixed to the lower lip beam 12. By rotating the screw 25 by means of a handle 26, it is possible to adjust the position of the air blow means 20 and thereby adjust the magnitude of the gap spaces $S_1$ and $S_2$ to thereby maintain the pressure in the wedge-shaped space S at a desired level.

Figure 3:
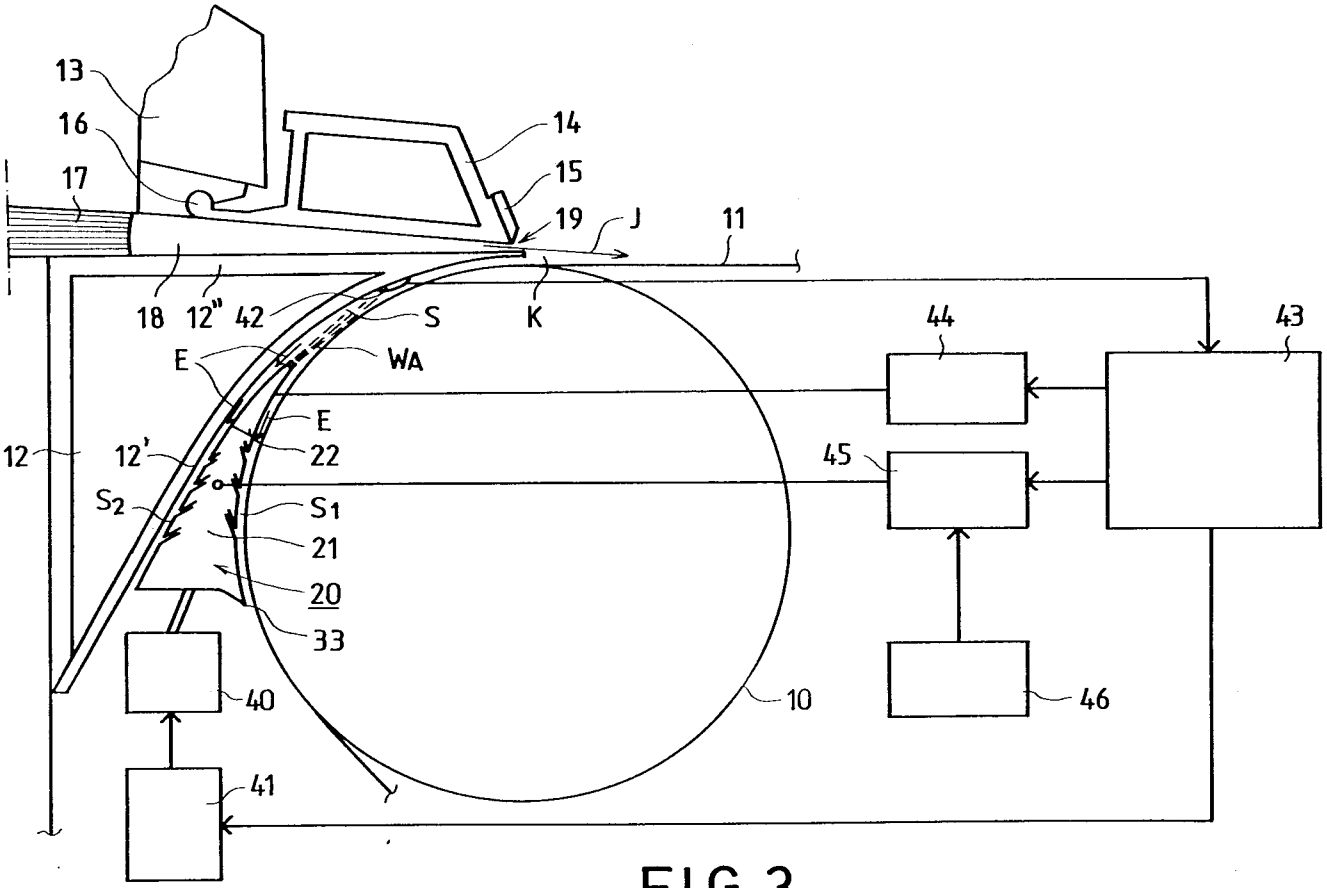
FIG. 3 is a schematic illustration of an embodiment of apparatus in accordance with the invention provided with a control system for maintaining the pressure in the wedge-shaped space at a desired level in an automatic manner.

Instead of the arrangement described above for manually adjusting the position of the air blow means 20, it is also possible to provide a control system for automatically maintaining the pressure level in the wedge-shape space S at a desired level. Referring to FIG. 3, the control system comprises actuating means in the form of a motor 40 which adjusts the position of the blow box 21 in the longitudinal direction within the wedge-shaped space S. The actuating motor 40 is controlled by an adjusting or regulating device 41. The pressure level in the wedge-shaped space S is sensed by pressure detector means 42 situated in the wedge-shaped space. Pressure detector means 42 senses the pressure in the space S and generates a signal indicative thereof which is received by an adjustment or control unit 43 which in turn sends a signal to the regulating device 41. In this manner, the pressure level in the space S can be maintained at a desired level through the adjustment of the position of the blow box 21. The pressure indicative signal received by the control unit 43 may be compared to a set point value input into the control unit 43 in a conventional manner.

In addition to or in lieu of the positional adjustment described above, the pressure level in the wedge-shape space S can be adjusted through the adjustment of the pressure level of the air supplied to the blow box 21. Referring to FIG. 3, a control valve 45 is positioned in the line between the source of compressed air 46 and the blow box 21 for adjusting the pressure level of the air supplied to the blow box. The control valve 45 receives a signal from the control unit 43 to adjust the pressure level of the air supplied to the blow box. By adjusting the pressure level of the supplied air, the speed of the air jets $A_1$ discharged from the blow box 21 can be controlled which affects the intensity of the air ejection effect, designated E, and thereby the pressure level in the space S. The supply of cleaning water from the water source 44 can also be controlled by the control unit 43 as indicated in FIG. 3.

In accordance with another feature of the invention, a blade-like member 33 is provided on blow box 21 at the intersection of the side wall 29 and back wall 31 adjacent to the breast roll 10, whose function is to prevent access of broken or cut-off wire 11 into the wedge-shaped space S. In the past, should the wire 11 have broken during operation, the wire tended to become packed into the wedge-shaped space requiring the machine to be shut-down for long periods of time. The provision of the blow box 2 having the blade-like member 33 attached thereto eliminates this possibility.

The blow box is positioned so that a portion of it is situated at the wide throat area of the wedge-shape space S so that in addition to ejecting the air E from within the space S by means of the air jets, access of air into the wedge-shape space is substantially prevented.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a paper machine, a method for maintaining pressure induced in a wedge-shaped space at a desired level, the wedge-shaped space being defined between a wall of a headbox lip beam or the like and a breast roll over which a forming wire passes, comprising the steps of providing a blow box in the wedge-shaped space, the blow box including a curved side wall which substantially follows the contour of the breast roll and which defines a first gap space with the breast roll; and directing air or gas jets from the blow box through nozzle openings in said curved side wall into and through the first gap space in a direction opposite to a direction in which the forming wire moves on the breast roll so that by means of the air jets, air is ejected from the wedge-shaped space to maintain the pressure therein at a desired level.

2. The method of claim 1 including the step of positioning the blow box so that a portion thereof is situated at a wide throat area of the wedge-shaped space to substantially prevent access of air into the wedge-shaped space.

3. The method of claim 1 including the further step of injecting water jets into said wedge-shaped space.

4. The method of claim 1 wherein said blow box includes an additional side wall which defines a second gap space with the beam wall, and wherein the air jet directing step comprises directing air jets through said first and second gap spaces.

5. The method of claim 1 including the further step of regulating the pressure in the wedge-shaped space by adjusting the position of the blow box within the wedge-shaped space substantially in a longitudinal direction.

6. The method of claim 1 including the further step of regulating the pressure in the wedge-shaped space by adjusting the pressure level of air supplied to the blow box.

7. In a paper machine including a headbox having a headbox lip beam, and a breast roll on which a forming wire passes, said breast roll and a wall of said headbox lip beam defining a wedge-shaped space between them, apparatus for maintaining the pressure induced in said wedge-shaped space at a desired level, comprising:

blow means situated in said wedge-shaped space for directing air or gas jets from: said wedge-shaped space in a direction opposite to a direction in which the forming wire moves on said breast roll, said blow means comprising a blow box including a curved first side wall which substantially follows the contour of the breast roll and which defines a first gap space with the breast roll, said first side wall having nozzle opening means formed therein through which said air jets are directed through said first gap space, whereby by means of the air jets, air is ejected from said wedge-shaped space to maintain the pressure therein at a desired level.

8. The combination of claim 7 wherein said blow box has a second side wall in opposed relationship to said wall of said head box lip beam to form a second gap space therewith, said second wall having nozzle opening means formed therein through which said air jets are directed through said second gap space.

9. The combination of claim 7 wherein said blow box is fitted tightly against said lip beam wall defining a side of said wedge-shaped space.

10. The combination of claim 7 wherein said blow box has a narrow end and a wider end, said wider end of said blow box being situated at a wide throat side of said wedge-shaped space.

11. The combination of claim 7 wherein said wedge-shaped space includes a narrow tip side and a wide throat side and further including means provided on said blow box in a region of said narrow tip side of said wedge-shaped space for directing water jets towards said narrow tip side of said wedge-shaped space.

12. The combination of claim 11 wherein said water jet directing means is coupled to a source of water under pressure and comprises a water supply duct in which nozzle means are formed.

13. The combination of claim 7 further including actuating means coupled to said blow box for adjusting the position of said blow box within said wedge-shaped space in a longitudinal direction for adjustably regulating the pressure in the wedge-shaped space.

14. The combination of claim 13 wherein said actuating means constitute a component of an automatic control system comprising detector means situated in said wedge-shaped space for sensing the pressure therein and generating a signal indicative of the sensed pressure, a control unit coupled to said detector means for receiving said pressure indicative signal from said detector means and generating a regulating signal, a regulating device coupled to said control unit and to said actuating means for receiving said regulating signal from said control unit and for, actuating said actuating means to control the position of said blow box within said wedge-shaped space.

15. The combination of claim 14 wherein said actuating means comprise a screw motor or pneumatic bellows device.

16. The combination of claim 7 further including blade means provided on said blow box for preventing said forming wire, if broken or cut-off, from entering into said wedge-shaped space.

17. The method of claim 1 further including the step of providing means on said blow box for preventing said forming wire, if broken or cut off, from becoming packed into said wedge-shaped space.

* * * * *